US006840806B2

(12) United States Patent
Kodama

(10) Patent No.: US 6,840,806 B2
(45) Date of Patent: Jan. 11, 2005

(54) ELECTRICAL CONNECTOR WITH LOCK AND SHIELD PIECES IN MIDDLE PLANE

(75) Inventor: Akihiro Kodama, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/729,988

(22) Filed: Dec. 9, 2003

(65) Prior Publication Data

US 2004/0115990 A1 Jun. 17, 2004

(30) Foreign Application Priority Data

Dec. 9, 2002 (JP) ..... 2002-356198

(51) Int. Cl.[7] ..... H01R 13/648
(52) U.S. Cl. ..... 439/607; 439/610
(58) Field of Search ..... 439/607–610, 439/79, 939, 1

(56) References Cited

U.S. PATENT DOCUMENTS 5,718,605 A * 2/1998 Morikawa et al. ..... 439/607
6,077,120 A * 6/2000 Futatsugi et al. ..... 439/607
6,168,466 B1 * 1/2001 Chiou ..... 439/607
6,508,678 B1 * 1/2003 Yang ..... 439/677
6,619,986 B1 * 9/2003 Yeh ..... 439/607
6,682,368 B2 * 1/2004 Murr et al. ..... 439/607

FOREIGN PATENT DOCUMENTS

JP 3076855 1/2001

* cited by examiner

*Primary Examiner*—Michael C. Zarroli
(74) *Attorney, Agent, or Firm*—Takeuchi & Takeuchi

(57) ABSTRACT

An electrical connector comprises a housing (12) and a substantially rectangular case (13) made of a metal and enclosing the housing. The rectangular case includes at least one connection portion (28) on a side of a lower surface thereof for connection with a circuit board, a resilient lock piece (20) and a pair of shield pieces (26) between the upper and lower surfaces the rectangular case for engaging a mating connector. The upper surface of the case is made flat for easy assembling with the housing. The resilient lock piece has a bending portion (21), which is bent toward an inner of the rectangular case and the shield pieces are provided on sides of the resilient lock piece.

9 Claims, 10 Drawing Sheets

ELECTRICAL CONNECTOR WITH LOCK AND SHIELD PIECES IN MIDDLE PLANE

BACKGROUND OF THE INVENTION

1. Field of the Invention

This invention relates to an electrical connector having a housing enclosed and held by a rectangular case made of a metal, especially a USB connector.

2. Description of the Related Art

An example of the USB connector is disclosed in Japanese Patent Application Kokai Number 3076855. The UBS connector is standardized and as shown in FIG. 2 of the reference, a receptacle connector, which is fixed to a circuit board, has a metal case of which lower surface is cut downward to provided a fixing leg and part of the upper surface is cut upward to provide a locking arm. The UBS connector shown in FIG. 2 is called a "miniature-type connector", and has a sectional shape of substantially "T" so as to have the locking arm and a shield piece in the upper side. A plug connector of the UBS connector has a display section on which information, such as the type of the connector, is indicated, and is plugged in the receptor connector with the display section facing upward. The upper surface of the plug connector, in which the display section is provided, has an engagement window to engage the locking arm of the receptor connector.

The plug connector is plugged in the receptor connector fixed on the circuit board of an electronic apparatus from an opening of a panel or case of the electronic apparatus.

An electronic apparatus has a convenient direction or orientation for usage and the method of fixing the receptacle connector is changed according to the convenient direction.

For example, a portable telephone is required to have a small thickness. In addition, a circuit board must be arranged in the vicinity of a display so that electronic components including the connector should be arranged on the lower surface of the circuit board. Consequently, the locking arm of the receptor connector faces downwardly so that the engaging window of the plug connector also faces downwardly. It means that the display section of the plug connector fronts to an opposite direction with the display of the portable telephone so that the user cannot see the display section of the plug connector when he/she is watching the display of the portable telephone. Even if the receptacle connector is used upside down to solve the problem, the locking arm and shield piece cannot obtain a sufficient amount of displacement because they are provided by cutting upward the upper surface of the metal case. Also, it is difficult to provide the locking arm and shield piece on the lower surface of the metal case together with the fixing legs because the fixing legs are provided there by cutting downward the metal case.

When the receptacle connector is fixed to the circuit board, the receptacle connector is absorbed and held by an automatic machine for pick-up from a container and brought to a predetermined position of the circuit board for solder-connection. However, as described above, the upper surface of the metal case of the receptacle connector is provided with the locking arm so that there is no flat plane having a sufficient space for the absorption. Accordingly, a heat-resistant tape is adhered to the upper surface to enable the automatic absorption prior to the absorption and then taken off after the receptacle connector is soldered to the circuit board, which needs time and labor.

BRIEF SUMMARY OF THE INVENTION

Accordingly, it is an object of this invention to provide an electrical connector with a rectangular case, which can be used while seeing the display and easily assembled automatically.

According to an aspect of the invention, an electrical connector comprises a housing and a substantially rectangular case made of a metal and enclosing the housing, the substantially rectangular case having a front opening and including at least one connection portion provided on a side of a lower surface of the substantially rectangular case for connection with a corresponding circuit trace of a circuit board, a resilient lock piece provided between an upper surface and the lower surface of the substantially rectangular case and engage a mating connector, and a pair of shield pieces provided between the upper and lower surfaces and brought into contact with a shield case of the mating connector, wherein the upper surface is made flat, the resilient lock piece has a bending portion at the front opening of the substantially rectangular case, which is bent from the lower surface toward an inner of the substantially rectangular case, and the shield pieces are provided on sides of the resilient lock piece.

According to such an electrical connector, when the display section of an electronic apparatus, such as a portable telephone, faces upward, electronic components, such as the electrical connector are positioned under a circuit board. When mounted on the circuit board, the electronic components are absorbed and transported by an automatic machine and soldered onto the circuit board at a predetermined position under the condition that the circuit board is turned upside down. The electrical connector according to the present invention is easily absorbed by the machine because the upper surface of the rectangular case is made flat.

When the apparatus is used, the connector is turned over with the circuit board, from the posture when it mounted to the circuit board so that the resilient lock piece is positioned on the side of the display of the apparatus, enabling the user to plug in the mating connector watching the display thereof.

The substantially rectangular case is made by bending a metal sheet around an axis of the substantially rectangular case or a plugging direction of the mating connector and has a joint of edges of the metal sheet on the upper surface. In that case, it is preferable that the joint is not present in the center of the upper surface so that the connector can be absorbed at the center by an automatic machine.

It is more preferable that the substantially rectangular case is made by bending a metal sheet around an axis of the substantially rectangular case or a plugging direction of the mating connector and has a joint of edges of the metal sheet on a side surface thereof so that the upper surface has no joint and is made completely flat.

Its is also preferable that the bent portion has a curvature to smoothly guide the mating connector.

The substantially rectangular case can have a lower opening in at least part of the lower surface to accommodate a bottom section of the housing. The housing is made of an insulating material so that even if a circuit section is provided at a corresponding position of the circuit board, there is no risk that the circuit section is short-circuited by the close approach or contact of the bottom section of the housing to or with the circuit section. Thus, the circuit section is arranged at the corresponding position effectively.

The substantially rectangular case has a projection portion extending forwardly from part of an edge of the front opening thereof. If the projection portion is inserted into a window of a front panel of the apparatus, the positioning of the connector is easily performed with respect to the window.

If a lower side of the bent portion of the resilient lock piece is positioned lower than that of a plane where the housing is fixed to the circuit board, part of the thickness of the bent portion is within the thickness of the circuit board so that the influence of the thickness of the bent portion on the height of apparatus is minimized.

DESCRIPTION OF THE PREFERRED EMBODIMENT

Embodiments of the present invention will now be described with reference to the accompanying drawings.

Figure 1:
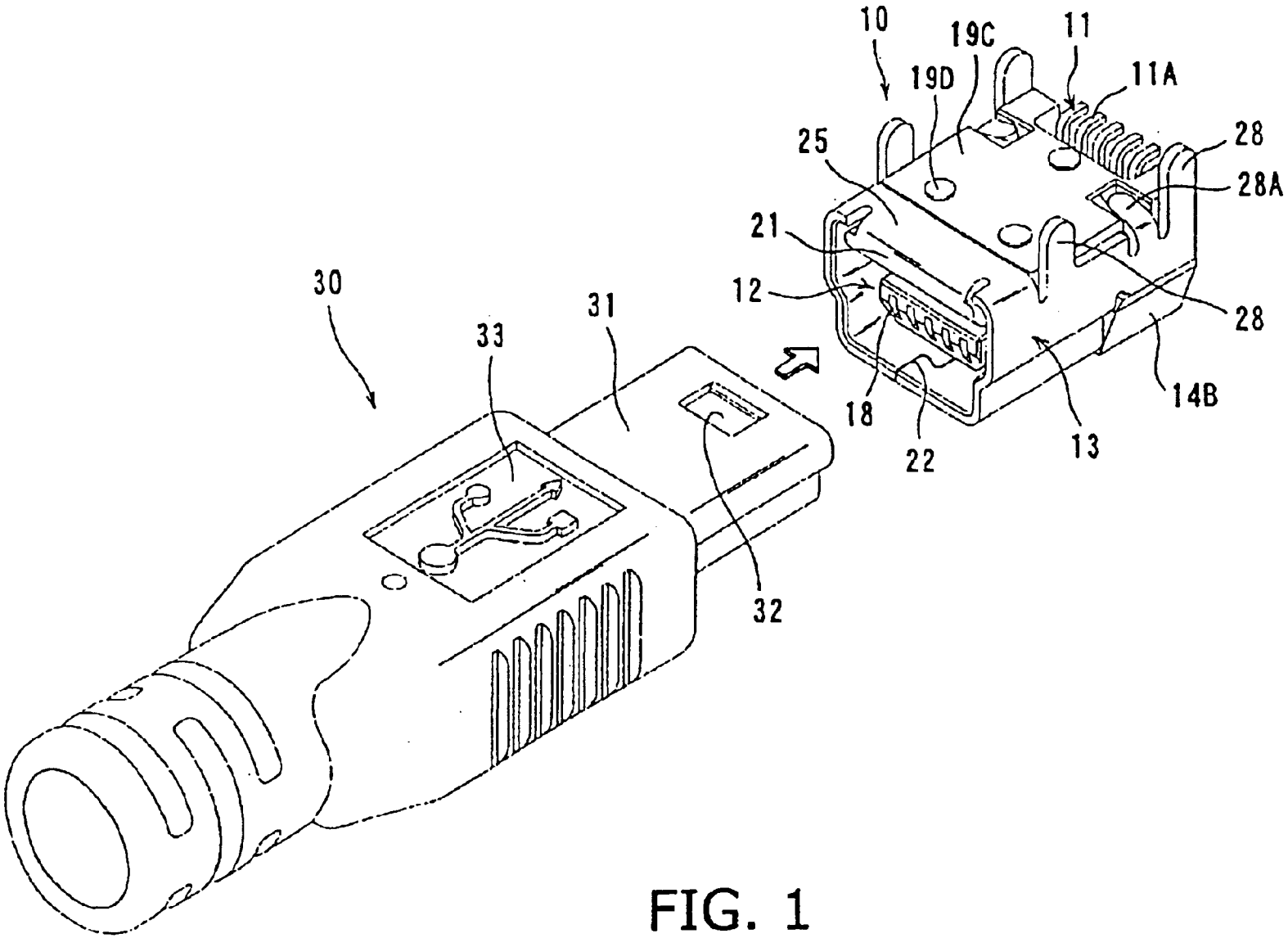
FIG. 1 is a perspective view of a receptacle connector according to an embodiment of the present invention and a mating plug connector prior to plug-in, with bottoms thereof facing upward.

FIG. 1, reference numeral 10 denotes a receptacle connector according to an embodiment of the present invention and 30 a mating plug connector to be plugged in the receptacle connector 10.

The bottom surface of the receptacle connector 10 shown in FIG. 1 faces upwardly so that it can be fixed to the lower surface of a circuit board (not shown) of an electronic apparatus. However, the receptacle connector 10 shown in FIG. 2 and after that faces downwardly to facilitate the understanding.

Figure 2:
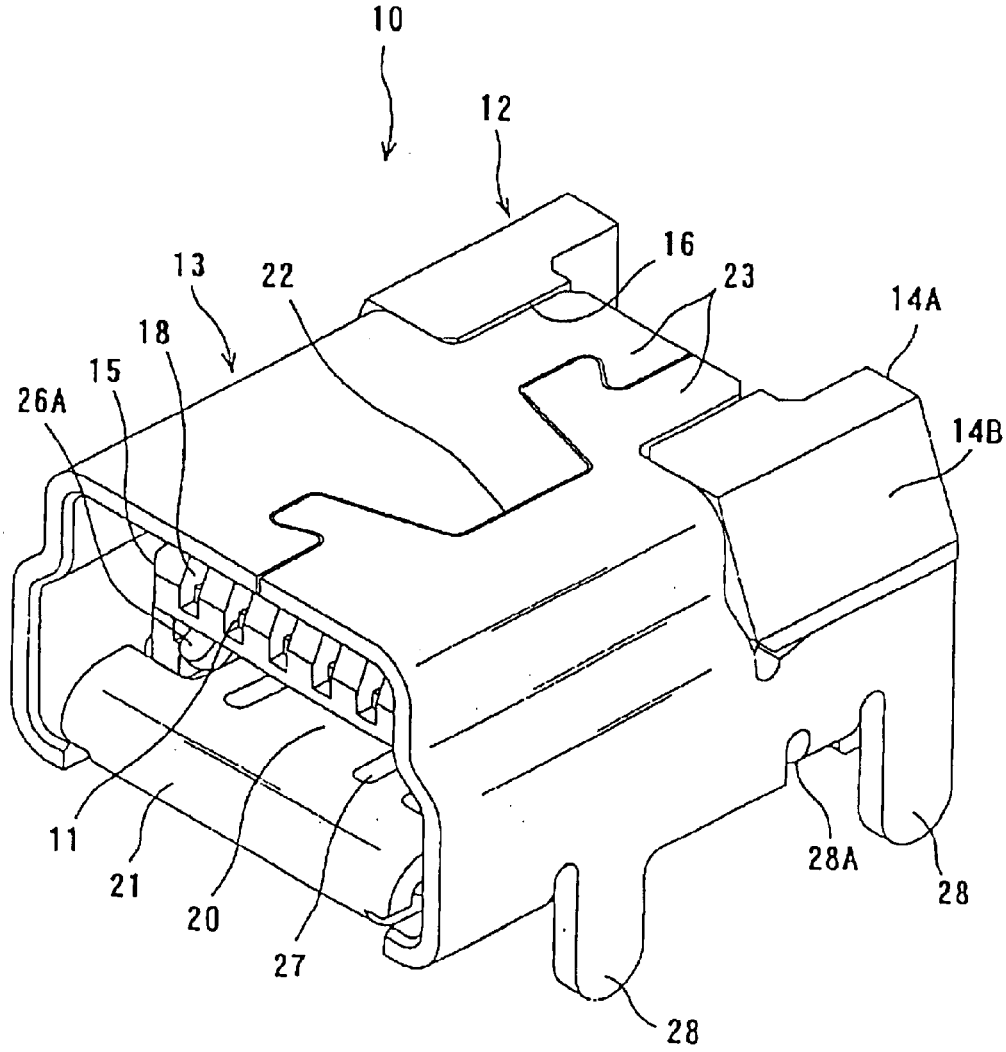
FIG. 2 is an upper perspective view of the receptacle connector of FIG. 1.
Figure 3B:
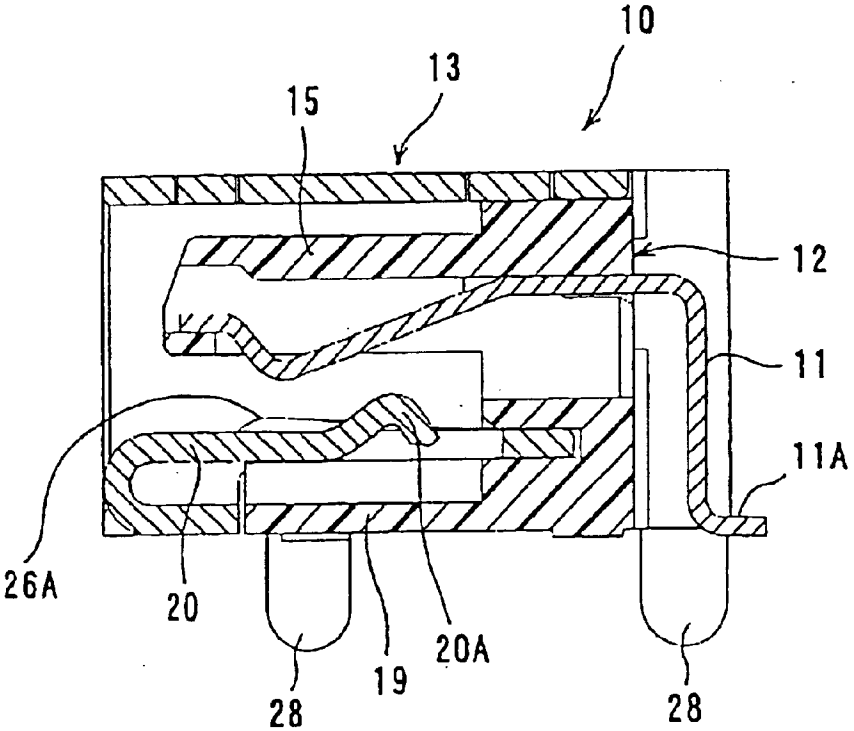
FIG. 3(B) is a sectional view of the receptacle connector of FIG. 3(A) taken along the line B—B.
Figure 3A:
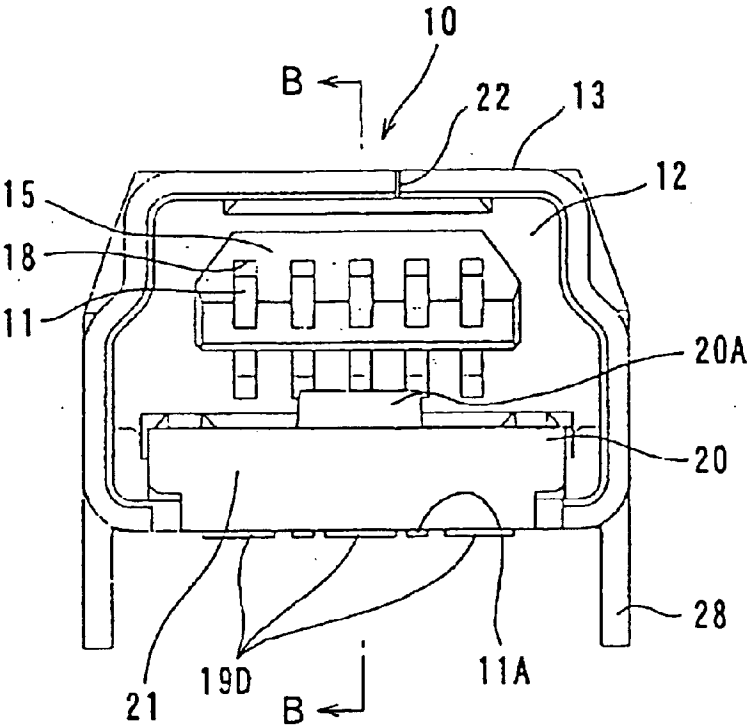
FIG. 3(A) is a front view of the receptacle connector of FIG. 2.
Figure 4:
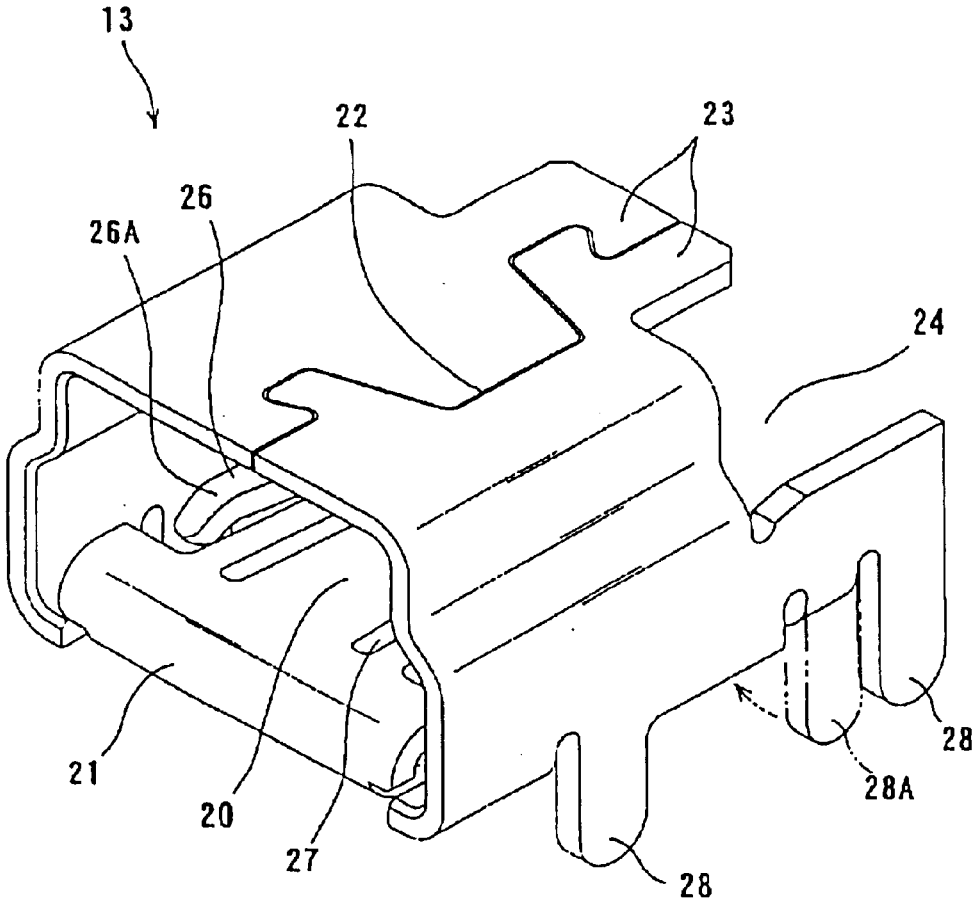
FIG. 4 is a perspective view of a shield case of the receptacle connector of FIG. 2.
Figure 5:
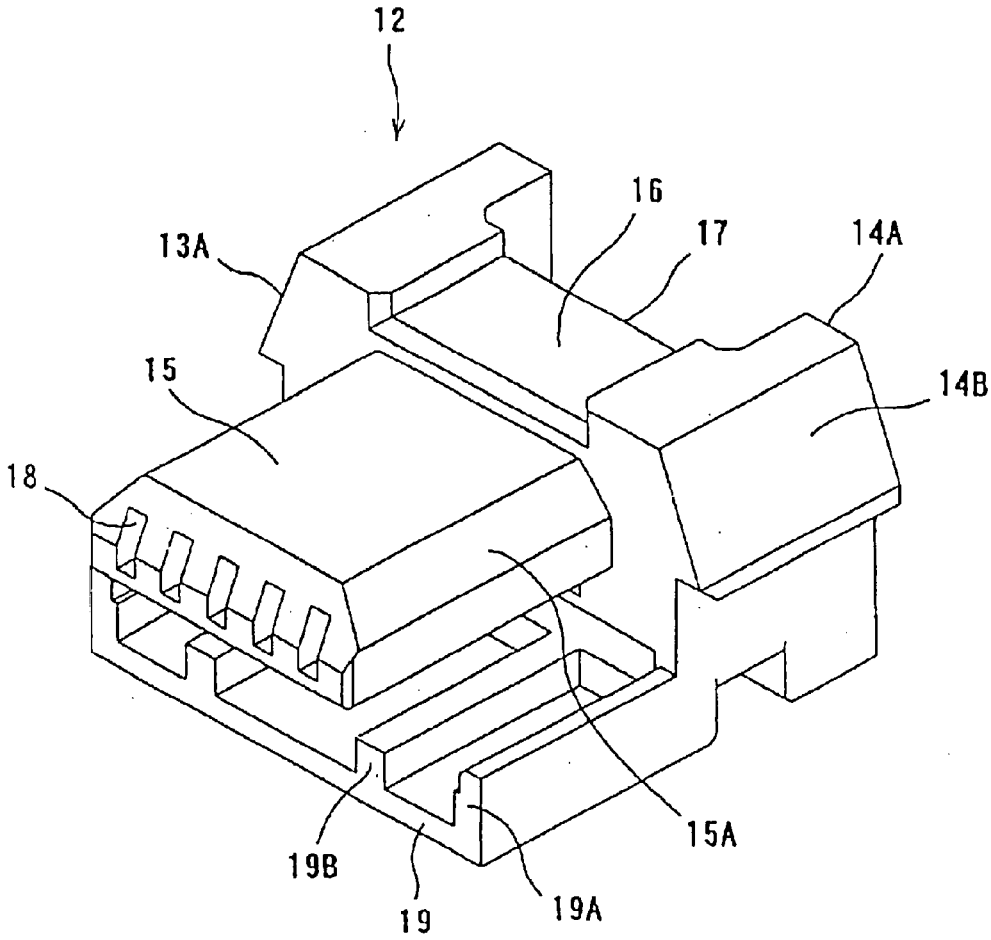
FIG. 5 is a perspective view of a housing of the receptacle connector of FIG. 2.
Figure 6:
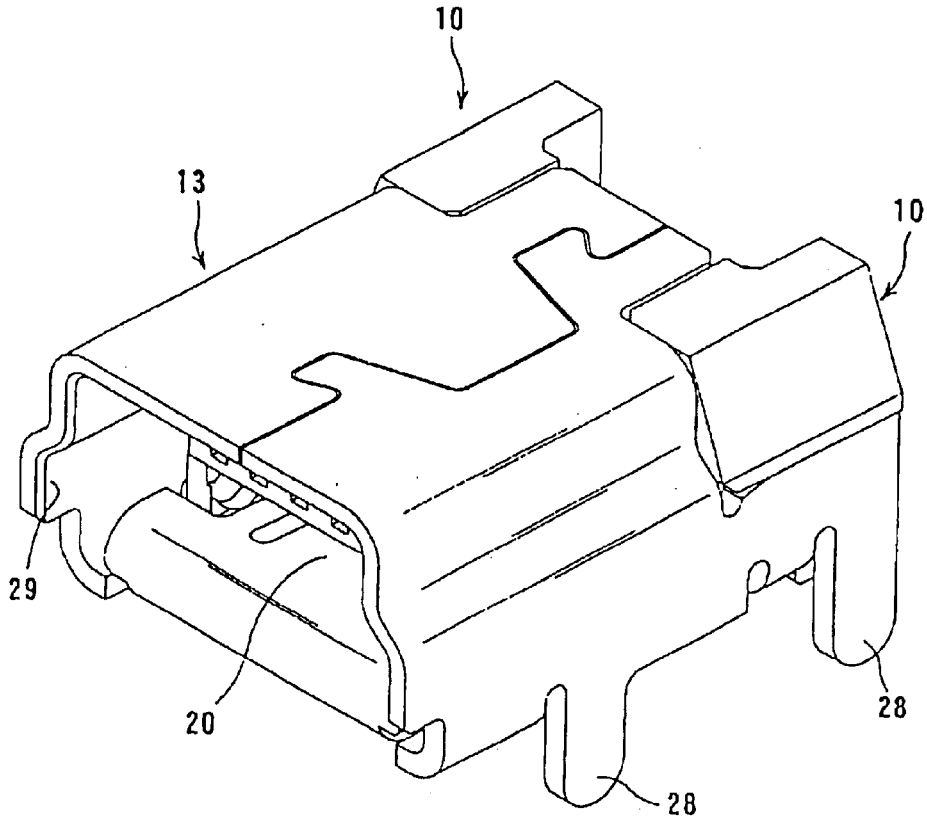
FIG. 6 is a perspective view of a housing of a receptacle connector according to another embodiment of the present invention.

As shown in FIGS. 1 and 2, the receptacle connector 10 comprises a housing 12, a plurality of terminals 11 provided in the housing 12, and a shield case 13 having a form of substantially rectangular tube (hereinafter "rectangular case") and enclosing substantially entire part of the housing 12.

In FIGS. 2–5, the housing 12 is made of an electrically insulating material and comprises a rear section 14 having a pair of shoulders 14A at an upper side thereof, a projecting section 15 extending forwardly from the upper portion of the rear section 14, and a bottom section 19 extending forwardly from the lower portion of the rear section 14. Each of the shoulder 14A has a slope 14B and a dent 16 having a depth corresponding to the thickness of the rectangular shield case 13 between the shoulders 14A. The rear section 14 has a hollow 17 opened rearwardly.

The projecting section 15 is made small than the rear section 14 by the dimension of the thickness of the shield case 13 so that the base portion of the projecting section 15 is stepped with respect to the rear section 14. The projecting section 15 comprises a pair of slopes 15A extending substantially in parallel to the slopes 14B. A plurality of terminal slots 18 extend through the projecting section 15 in the back-and-fourth direction to accommodate the terminals 11. The terminals 11 are bent in a crank form and each terminal 11 is inserted into the terminal slot 18 from the rear side such that the front end thereof remains inside the terminal slot 18 to make a contact portion and the L-shaped rear end extends downwardly from the terminal slot 18 to make a connection portion 11A at the substantially same level with the bottom of the housing 12.

The bottom section 19 extends forwardly from the rear section 14 in parallel with the projecting section 15 and comprises side ribs 19A and center ribs 19B provided at the sides and center thereof, respectively. Circular thin projection 19D are provided in a bottom surface 19C (upper side surface in FIG. 1) of the bottom section 19.

The shield case 13 is made by stamping a metal sheet in a predetermined unfolded form and bending or folding it in a designated way. In this embodiment, a bent portion 21 is folded inside to provide a resilient lock piece 20 before forming a shape of the rectangular shield case. Upon forming the rectangular shield case 13, both edges of the metal sheet are stamped to have square waves so that they are joined at a joint 22 such that the square waves of both the edges fit each other. Especially, the joint 22 has a big square wave in the center to bypass the center of the upper surface of the shield case 13 (FIG. 2). That is, no joint 22 is present in the center of the upper surface. The joint 22 may be press-crushed or bent-joined or overlapped with each other to strengthen the joining force.

The shield case 13 has a projection 23 in the upper surface thereof which extends rearwardly to be plugged in the dent 16 of the housing 12, and cut-off portions 24 at sides of the projection 23 to receive the upper part and the slops 14B of the shoulder 14A. When the housing 12 is inserted into the shield case 13, the upper face of the shield case 13 including the projection 23 is substantially flush with the upper part of the shoulders 14A of the housing 12. Also, as shown in FIG. 1, when the bottom section 19 of the housing 12 is accommodated in the open section of the bottom 25 of the shield case 13, the bottom 25 of the shield case 13 is substantially flush with the bottom surface 19C of the bottom section 19 of the housing 12.

The resilient lock piece 20 of the shield case 13 extends inside the shield case 13 substantially in parallel with the bottom 25 of the shield case 13 through the bent portion 21 having a curvature. A pair of shield arms 26 are provided on sides of the resilient lock piece 20. The area including the resilient lock piece 20 and the shield arms 26 has a width smaller that that of the bent portion 21 such that the area is within the ribs 19A provided on the sides of the bottom section 19 of the housing 12. A U-shaped kerf 27 is provided within the area to define the resilient lock piece 20 in the inside of the U-shape. A locking hook 20A is provided at the end of the resilient lock piece 20. The shield arms 26 are integrally made with the resilient lock piece such that they extend forwardly from the inner part of the kerf 27 in parallel with the resilient lock piece. The shield arms 26 are provided with contact portions 26A which is swollen at the front of the front opening of the shield case 13 to be brought into resilient contact with a shield member of the mating connector. It is possible to make a lock piece extending outwardly or in the same direction as the shield arms by providing a kerf in a form of reverse-U.

Connection legs 28 extending downwardly and supporting legs 28A bent inside afterwards are provided at sides of the bottom surface of the shield case 13.

The housing 12 carrying the terminals 11 is assembled into the shield case 13 to provide the receptacle connector 10. The housing 12 is inserted into the shield case 13 from the rear side of the shield case 13. The stepped front of the rear section 14 of the housing 12 abuts against the rear end of the shield case 13 for positioning. The resilient lock piece 20 and shield arms 26 are positioned between the projecting section 15 and the bottom section 19 of the housing 12. As describe above, the bottom section 19 of the housing 12 is flush with the bottom 25 of the bent portion 21 of the shield case 13, and the connection portion 11A of the terminals 11 is also positioned in the same plane.

The housing 12 is supported or held by bending the supporting legs 28A of the shield case 13 (FIG. 1).

As shown in FIG. 1, the mating plug connector 30 comprises a plug projection which is enclosed by a shield case 31. The shield case 31 has a shape suitable for plugging in the shield case 13 of the receptacle connector 10 and comprises an engaging window 32 in the upper surface thereof to engage the lock locking hook 20A of the resilient lock piece 20 of the receptacle connector 10. A display section 33 is provided in the upper surface of the body of the plug connector 30.

How to use the connector according to the present invention will be described below.

1. The receptacle connector 10 in the posture shown in FIG. 2 is absorbed by the automatic machine with an absorber, which absorbs the connector 10 at the upper center of the connector 10, and transported to a predetermined position of a circuit board (not shown) which has not been assembled into the electronic apparatus.

2. Then, the receptacle connector 10 is connected to a predetermined position of the circuit board by soldering. That is, the connection legs 28 are inserted into holes provided in a circuit section of the circuit board and connected by soldering to the circuit section for grounding, and the connection portions 11A of the terminals 11 are connected to corresponding circuit trances by soldering. The connection legs 28 may have a SMT shape instead of a DIP shape. Alternatively, the lower surface of the shield case 13 may be directly fixed to the grounding circuit section.

3. The front opening of the receptacle connector 10 is usually positioned at the window of the panel of the electronic apparatus. For example, in case of a portable telephone, the circuit board is fixed to the telephone after turning the circuit board upside down so as to place the receptacle connector 10 under the circuit board so that the mating connector can be inserted into the receptacle connector 10 from the window with the display of the portable telephone facing upward. FIG. 1 shows the posture of the connector 10 in this condition.

4. Consequently, the plug connector 30 is plugged in the receptacle connector 10 through the window of the panel of the electronic apparatus with the display section 33 thereof facing upward, thus connecting the terminals of both the connectors 10 and 30.

5. The contact portions 26A of the shield arms 26 of the with shield case 31 of the plug connector 30 and the locking hook 20A of the receptacle connector 10 is engaged with the engaging window of the shield case 31 to prevent the slip off of the connectors 10 and 30.

The present invention is not limited to the embodiments shown in FIGS. 1–6, and various modifications are possible.

Figure 7:
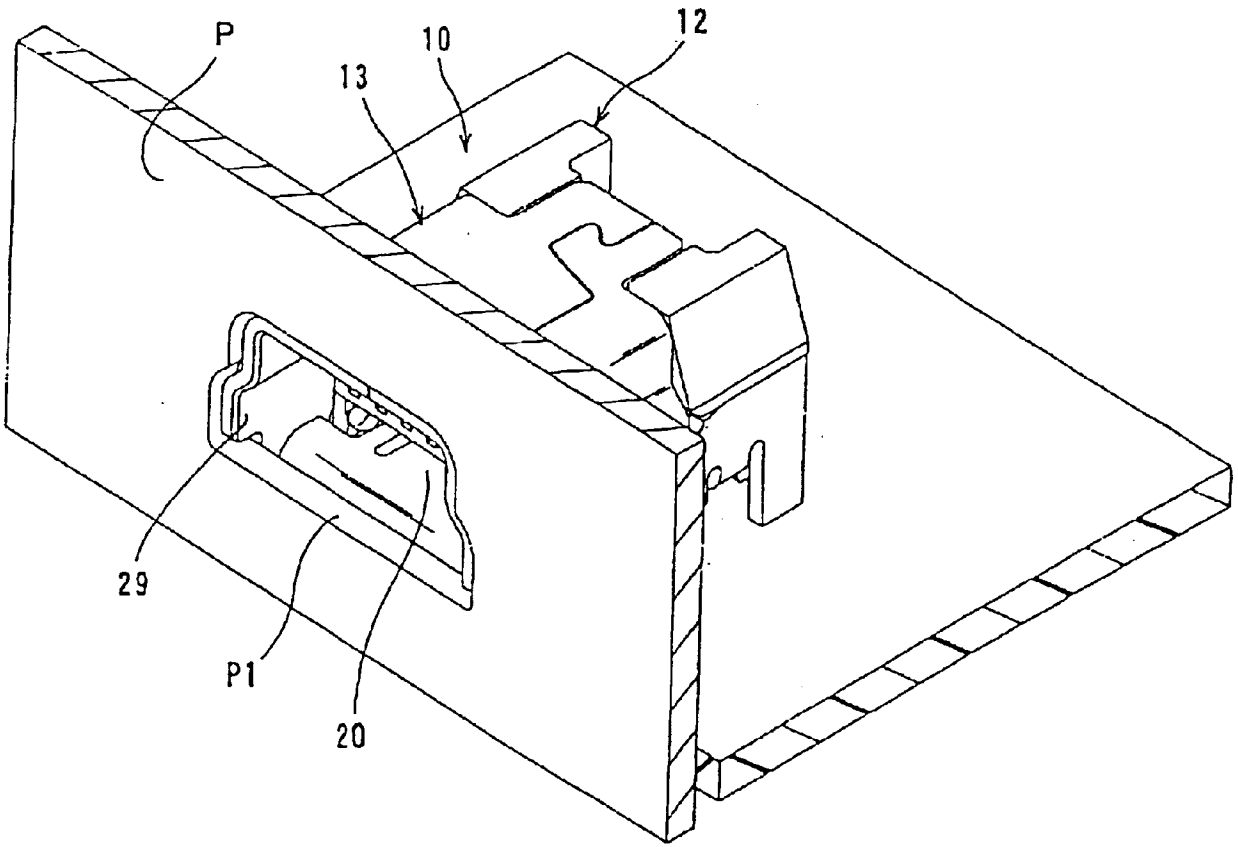
FIG. 7 is a perspective view of the receptacle connector of FIG. 6 in use.
Figure 8:
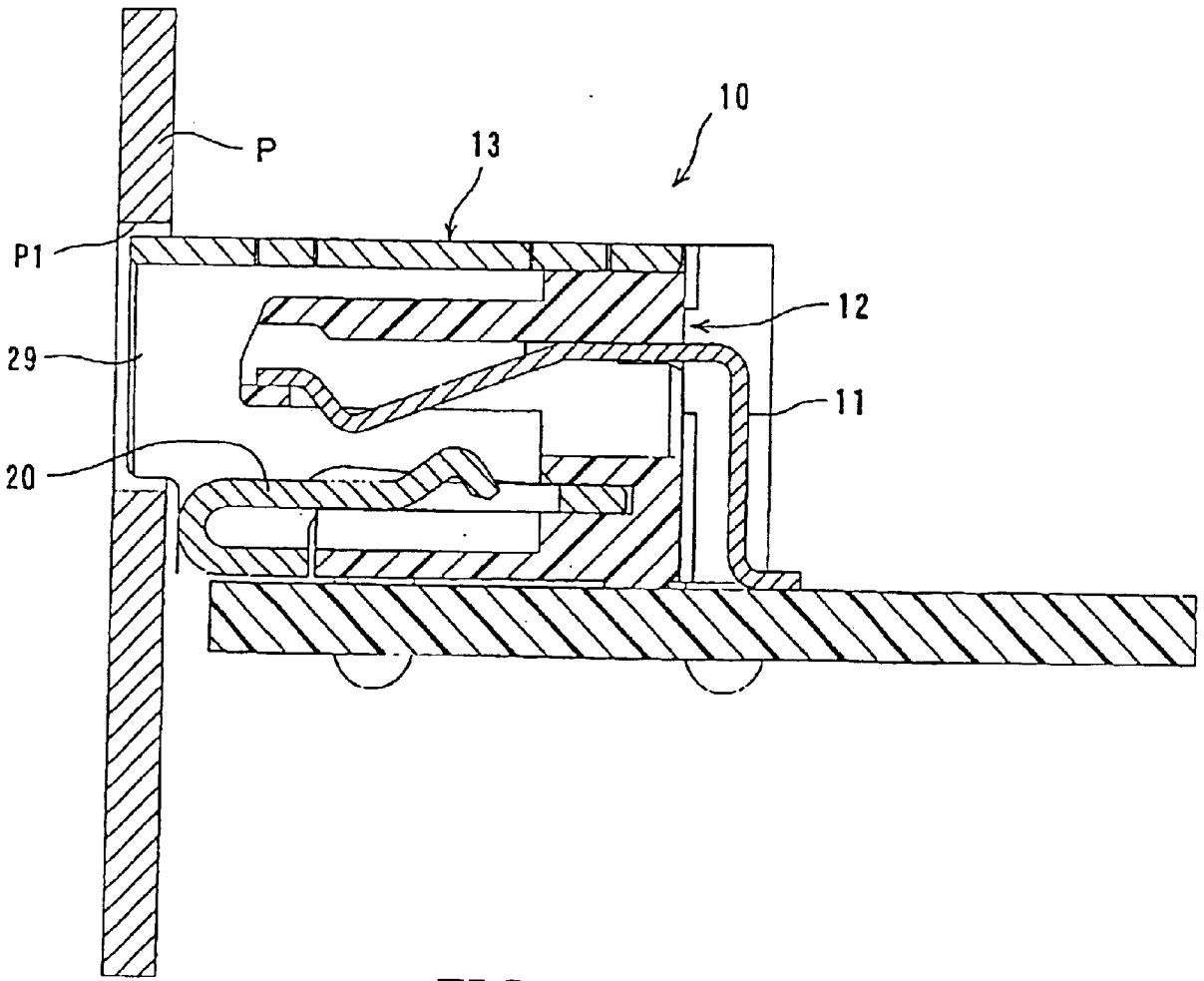
FIG. 8 is a sectional view of the receptacle connector of FIG. 7.

For example, in FIGS. 7 and 8, a projection piece 29 extends forwardly from part of the front opening edge of the shield case 13 so that the projection piece 29 abuts against a panel window P1 provided in a front panel P of the electronic apparatus to facilitate the positioning. Accordingly, the joint portion 22 is strengthen against the forced insertion of or strong push by the plug connector 10.

Figure 9:
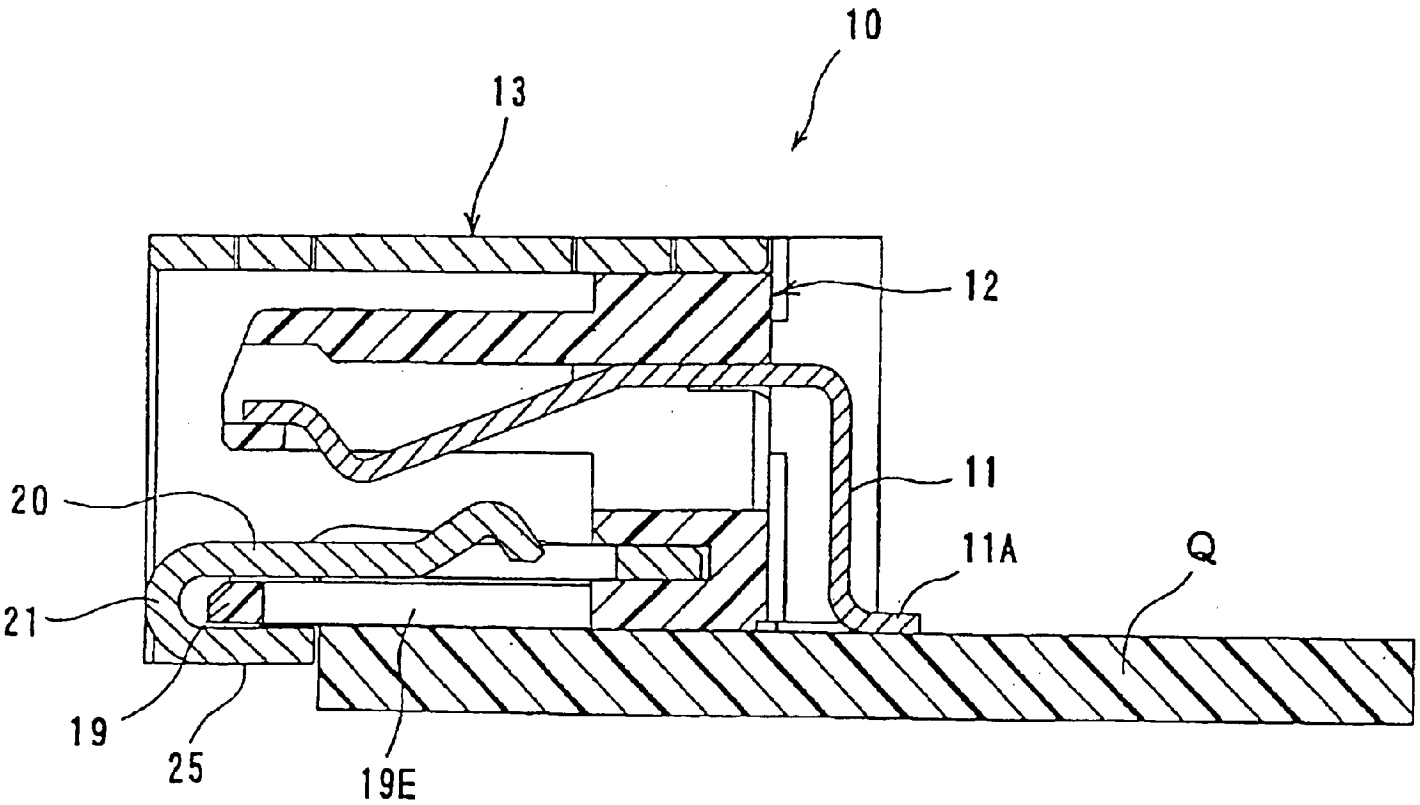
FIG. 9 is a sectional view of a receptacle connector according to still another embodiment of the present invention.

In FIG. 9, a lower side 25 of the bent portion 21 of the shield case 13 is positioned lower than that of a plane where the connector is fixed to a circuit board Q so that part of the thickness of the bent portion 21 falls into the range of the thickness of the circuit board Q, resulting in a low profile of the connector. In this case, a through space 19E extending up to the lower part of the bottom section 10 of the housing 12 is provided between the ribs 19A and 19B to permit the resilient lock piece 20 to flex to the through space 19E, thus contributing to the low profile of the housing 12. The supporting legs 28A of the housing 12 may extend rearwardly and bent behind the housing 12 to support the housing 12.

Figure 10:
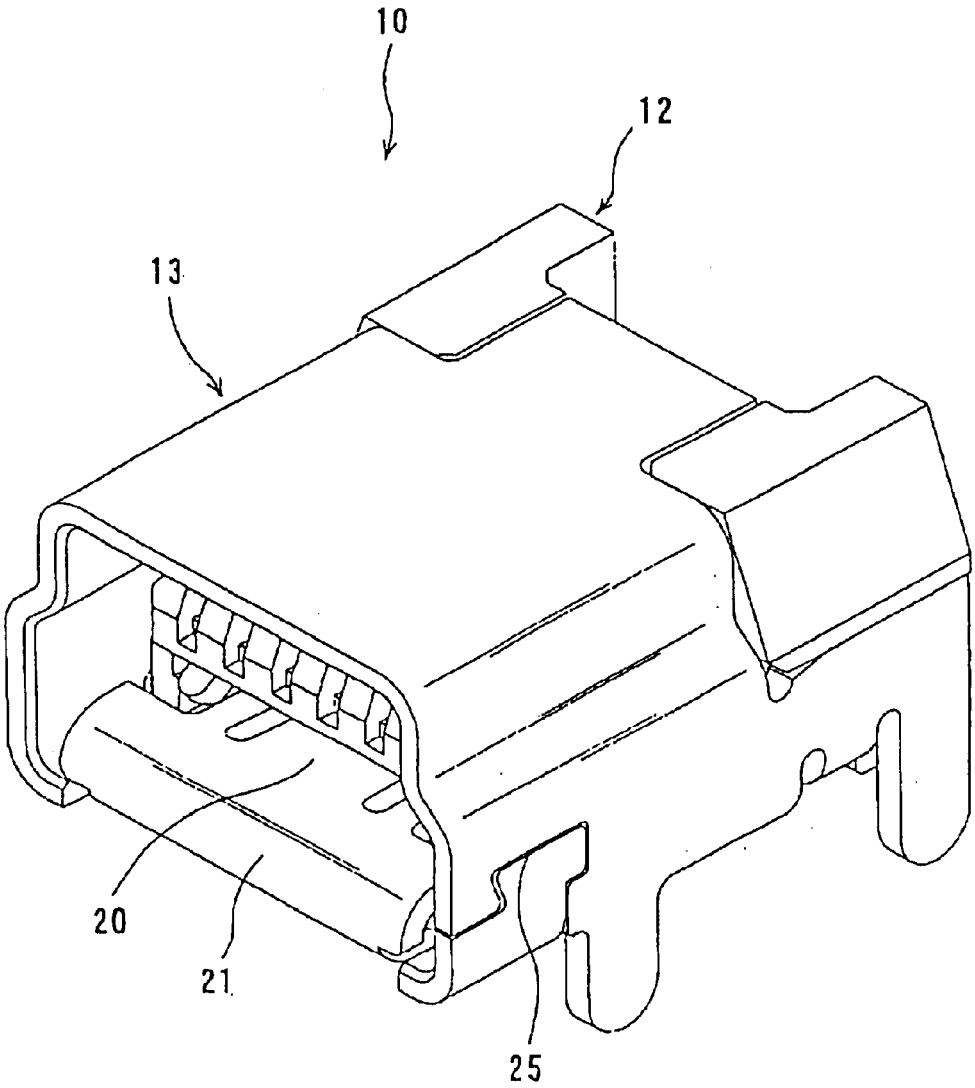
FIG. 10 is a sectional view of a receptacle connector according to yet another embodiment of the present invention.

In FIG. 10, since the joint portion 22 of the shield case 13 is provided in the side surface of the shield case 13 instead of the upper surface thereof, no joint portion 22 is present in the upper surface. Accordingly, when absorbing the connector to assemble it the circuit board, it is not necessary to exactly adjust the absorption position at the center of the shield case 13.

As fully described above, according to the present invention, the upper surface of the shield case enclosing the housing is made flat and the resilient lock piece is provided on the side of the lower surface thereof so that the connector can be absorbed easily at the upper surface by automatic machine and even if the connector is used upside down to minimize the size of the apparatus, the mating plug connector (USB connector) can be plugged in, while watching the display portion thereof.

What is claimed is:

1. An electrical connector comprising:

a housing; and a substantially rectangular case made of a metal sheet and enclosing said housing, said substantially rectangular case having a front opening and including:

at least one connection portion provided on a side of a lower surface of said substantially rectangular case for connection with a corresponding circuit trace of a circuit board;

a resilient lock piece provided between an upper surface and said lower surface of said substantially rectangular case and engaging a mating connector; and a pair of shield pieces provided between said upper and lower surfaces and brought into contact with a shield case of said mating connector, wherein said upper surface is made flat, said resilient lock piece has a bending portion at said front opening of said substantially rectangular case, which is bend from said lower surface toward an inner portion of said substantially rectangular case, and said shield pieces are provided on opposite sides of said resilient lock piece so as to extend in parallel to said resilient lock piece from said bending portion toward said inner portion and then toward said front opening of said substantially rectangular case in substantially the same plane as that of said resilient lock piece.

2. The electrical connector according to claim 1, wherein said upper surface has a width smaller than that of said lower surface.

3. The electrical connector according to claim 1, wherein said substantially rectangular case is made by bending a metal sheet around an axis of said substantially rectangular case or a plugging direction of said mating connector and has a joint of edges of said metal sheet in said upper surface.

4. The electrical connector according to claim 3, wherein said joint is not present in a center of said upper surface.

5. The electrical connector according to claim 1, wherein said substantially rectangular case is made by bending a metal sheet around an axis of said substantially rectangular case or a plugging directing of said mating connector and has a joint of edges of said metal sheet in a side surface thereof.

6. The electrical connector according to claim 1, wherein said bend portion has a curvature.

7. The electrical connector according to one of claims 1–5, wherein said substantially rectangular case has a lower opening in at least part of said lower surface to accommodate a bottom section of said housing.

8. The electrical connector according to one of claims 1–5, wherein said substantially rectangular case has a projection portion extending forwardly from part of an edge of said front opening.

9. The electrical connector according to claim 1, 5, or 6, wherein a lower side of said bent portion of said resilient lock piece is positioned lower than that of a plane of said housing fixed to said circuit board.

* * * * *